United States Patent [19]

Maier-Laxhuber et al.

[11] Patent Number: 5,038,581

[45] Date of Patent: Aug. 13, 1991

[54] SORPTION COOLING SYSTEM

[75] Inventors: Peter Maier-Laxhuber, Munich; Fritz Kaubek, Gauting, both of Fed. Rep. of Germany

[73] Assignee: Zeo-Tech (Zeolith Technologie GmbH), Munich, Fed. Rep. of Germany

[21] Appl. No.: 432,489

[22] Filed: Nov. 7, 1989

[30] Foreign Application Priority Data

Nov. 8, 1988 [DE] Fed. Rep. of Germany .... 3837872.8

[51] Int. Cl.[5] ..... F17C 13/00; F25B 21/00

[52] U.S. Cl. ..... 62/457.9; 62/393; 62/478; 62/480

[58] Field of Search ..... 62/457.9, 393, 448, 62/449, 480

[56] References Cited

U.S. PATENT DOCUMENTS

| | | | |
|---|---|---|---|
| 1,512,623 | 10/1924 | Maxwell . | |
| 1,808,056 | 6/1931 | Mitchell . | |
| 2,027,571 | 1/1936 | Altenkirch et al. | 62/478 X |
| 2,053,683 | 9/1936 | Schlumbohm . | |
| 2,323,902 | 7/1943 | Kleen | 62/480 |
| 3,018,638 | 1/1962 | Winkler | 62/457.9 X |
| 3,257,817 | 6/1966 | Leonard, Jr. | 62/393 X |
| 4,205,531 | 6/1980 | Brunberg et al. | 62/480 X |
| 4,250,720 | 2/1981 | Siegel | 62/480 |
| 4,479,364 | 10/1984 | Maier-Laxhuber et al. | 62/141 |
| 4,531,384 | 7/1985 | Paeye | 62/477 |
| 4,660,629 | 4/1987 | Maier-Laxhuber et al. | 165/104.12 |
| 4,674,563 | 6/1987 | Maier-Laxhuber et al. | 165/104.12 |
| 4,752,310 | 6/1988 | Maier-Laxhuber et al. | 62/480 X |
| 4,759,191 | 7/1988 | Thomas et al. | 62/480 X |
| 4,802,341 | 2/1989 | Maier-Laxhuber et al. | 62/235.1 |
| 4,924,676 | 5/1990 | Maier-Laxhuber et al. | 62/59 |

FOREIGN PATENT DOCUMENTS

| | | |
|---|---|---|
| 410423 | 2/1925 | Fed. Rep. of Germany . |
| 636013 | 9/1936 | Fed. Rep. of Germany . |
| 2715075 | 4/1977 | Fed. Rep. of Germany . |
| 2720561 | 5/1977 | Fed. Rep. of Germany . |
| 513598 | 2/1955 | Italy . |
| 312422 | 5/1929 | United Kingdom . |

OTHER PUBLICATIONS

Zeolith-Wasser: Neues Stoffpaur Fur Warmepumpen Und Warmespeicher Dr. Peter K. Maier-Laxhuber, Published Feb. 1984, pp. 45–46.

*Primary Examiner*—Lloyd L. King
*Attorney, Agent, or Firm*—Hoffmann & Baron

[57] ABSTRACT

Sorption cooling system of the present invention comprises a transportable cooling unit and a stationary charging (i.e. desorption) station. The transportable cooling unit includes an adsorption container containing an adsorption medium, a cooling container containing a liquid operating medium, and a heat exchanger contained within the cooling container and being surrounded by the liquid operating medium. An operating medium vapor conduit connects the adsorption container and the cooling container, and includes a shut off device which renders the operating medium vapor conduit selectively closable. The stationary charging station is detachable from the cooling unit, and includes a temperature controlled heating box having an opening for receiving the adsorption medium container of the transportable cooling unit, so that a discharged adsorption medium container can be selectively heated to desorb the operating fluid therefrom to form vapor which is condensed to liquid form and stored in the cooling container. After desorbing the operating medium from the adsorption medium using the charging station, the shut off device is closed and the cooling unit is removed from the charging station and allowed to cool, thereby charging the cooling unit for a new use.

10 Claims, 2 Drawing Sheets

SORPTION COOLING SYSTEM

FIELD OF INVENTION

The present invention relates generally to sorption cooling apparatus, and more particularly to a periodically-operable sorption cooling system having a cooling container and an adsorption container.

BACKGROUND OF THE INVENTION

In the field of the transportable beverage cooling, hitherto, only cooling devices which operate in accordance with the compression principle, have been widely used. These compressor cooling devices essentially consist of a hermetically sealed compressor, an air-cooled condenser, a collecting container for the liquid CFC, a temperature controlled expansion valve, and a condenser. However, the "cold" generated in the evaporator of such devices, must be intermediarily stored in a "cold buffer."

In connection with compression cooling devices, commonly used "cold buffers" include either a water container with a water content of up to 20 liters, or are formed from a large aluminum block in order to provide desired cold storage. Notably, large aluminum block cold buffers have an advantage over the water container type cold buffer, in that the aluminum block type cold buffer does not need to be filled up with water before operating the compression cooling device. However, each such "cold buffer" has its shortcomings and drawbacks. In particular, the largest disadvantage of the aluminum block "cold buffer" is that the storage capacity is relatively small, so that during "beverage tapping" of more than 0.5 liter of beverage, the cooling effect of the cooling device is already exhausted. The water storage cold buffer is disadvantageous in that after filling it with water, the cooling device must be in use for a longer time period to precool the filled water storage itself. Moreover, the water container must be provided with an additional stirring means which pumps the water around the evaporator and cooling coils for a better heat exchange. This mechanical stirrer is rather susceptible to trouble and very often results in the breakdown of the total cooling device.

Such compression cooling devices described above, are used for cooling of beverages, such as beer, lemonades, etc., in party tents or otherwise during a party. The use of such compression cooling devices by a private person for cooling a beverage (e.g. in a rented beer barrel) has hitherto only been possible in a limited manner. This is due to the fact that the highly complex nature of such compression cooling devices requires that the user has a lot of technical know-how for proper operation. For the beverage merchant, such compression cooling devices cannot be profitably used in view of the high purchase and maintenance costs of such cooling devices.

In contrast to compression type cooling devices, there are a class of sorption devices which operate on fundamentally different set of thermodynamic principles.

In connection therewith, sorption devices are understood to mean devices wherein a liquid or sold sorption medium absorbs a second medium at a higher temperature and in the vapor state, by releasing heat. Before the operating medium is absorbed by the sorption agent, it evaporates under heat absorption in a cooling container. Thus, the evaporation temperatures are in the range of between −40° and +40° C., depending on the type of operating medium used and the field of use of the sorption medium.

Sorption apparatuses with solid adsorption mediums, referred to as "adsorption" apparatuses, operate periodically, that is, an adsorption phase is always followed by a desorption phase, wherein the operating medium (e.g. water) is again separated or driven off from the adsorption medium, e.g. zeolite. During the desorption phase, the operating medium cannot be absorbed and can therefore also not be evaporated. Hence, during the desorption phase, no cooling effect is generated (i.e. no absorption of heat is achieved) in the cooling container.

An example of a periodically operating adsorption cooling apparatus is disclosed in German Patent Application DE-OS 34 25 419. In such apparatus, an ice bank is generated in the cooling container during the adsorption phase by a partial evaporation of the water operating medium. As disclosed, the adsorption cooling apparatus includes an adsorption container which is filled with the adsorption medium, zeolite; a cooling container which contains the operating medium, water; and a shut off device, with the assistance of which, a steam or vapor conduit is closable between the adsorption container and the cooling container. Cold can be discharged over the surfaces of the cooling container for cooling, for example, a cooling bag, while heat can be discharged over the container walls of the adsorption container. During the desorption phase, the operating medium is desorbed from the adsorption medium by supplying desorption heat into the adsorption container and is subsequently condensed in the cooling container by releasing heat. After completion of this desorption process, the shut off device is closed and the adsorption container is allowed to cool. In this condition, the adsorption apparatus can be stored for any given length of time, for future use.

However, using prior art periodically-operating adsorption apparatus, hitherto it has been not possible to cool large amounts of liquid (e.g. beverage) down to temperatures between +4° and +10° C. independent of any given initial temperature thereof.

Accordingly, it is a primary object of the present invention to provide a sorption cooling system which is characterized by a simple and cost effective type of structure, which is capable of cooling with a very low control effort, large amounts of liquid down to temperatures between +4° and +10° C. starting from any given initial temperature.

Another object of the present invention is to provide a sorption cooler which employs a single charging station, which can be used to recharge discharged tranportable cooling units, each of which is detachable from the charging station after being recharged by desorption.

These and other objects of the present invention will become apparent hereinafter and in the claims.

SUMMARY OF THE INVENTION

According to one of the broader aspects of the present invention, there is provided a periodically-operable sorption cooling system comprising a transportable cooling unit and a separate stationary charging station which is selectively detachable from the cooling unit. In general, a large number of the cooling units can be charged (i.e. desorbed) using a single charging station.

In order that the cooling units are easily transportable, they have each been formed merely from the technically required parts to perform the adsorption phase of a periodically-operable sorption cooling process. Thus, each working unit comprises: an adsorption container filled with an adsorption medium; a cooling container containing the liquid operating medium and a heat exchanger installed therein; an operating medium vapor conduit connecting the adsorption container with the cooling container; and a shut off means which renders the vapor conduit selectively closable.

When the transportable cooling unit is in the "charged" condition, the operating medium is separated from (i.e. desorbed or driven off) the adsorption medium and is in the form of a liquid contained in the cooling container. Also, the shut off means is closed and the adsorption and operating medium preferably are at an ambient temperature. In this charged condition, the cooling unit may then be lent to the customer, for example, together with a barrel of beer. In order to cool the barrel of beer with the cooling unit, the customer simply connects the beverage lines of the beer cooler to the heat exchanger of the cooling unit, and then opens the shut off means. Upon opening the shut off means, the operating medium can evaporate in the cooling container, flow through the operating medium vapor conduit to the adsorption medium, and can be adsorbed by the same releasing heat of adsorption. Notably, the adsorption heat is passed over and/or through the walls of the adsorption container and discharged to the ambient air, for example. As a result of the evaporation of a portion of the operating medium within the cooling container, the temperature of the operating medium remaining within the cooling container is lowered and a portion thereof freezes, and as a result, a beverage flowing through the heat exchanger is cooled. Also, by selectively controlling the opening and closing of the shut off means, in response to sensed temperatures, the discharge temperature of the beverage can be controlled in a desired manner.

Alternatively, instead of air cooling of the adsorption container, water cooling thereof may be provided. In such a case, the adsorption container will be advantageously coupled with a water container, whose water content can absorb the adsorption heat released during the adsorption phase of operation.

BRIEF DESCRIPTION OF THE DRAWINGS

The drawings illustrate one exemplified embodiment of a sorption cooling system constructed in accordance with the present invention, in which.

DETAILED DESCRIPTION OF THE PREFERRED EMBODIMENT

For purposes of illustration, in the preferred embodiment, the operating medium 15 is water and the adsorption medium 25 is a zeolite. However, within the principles of the present invention, it is believed that other adsorption pairs are expected to work with acceptable results.

Figure 1:
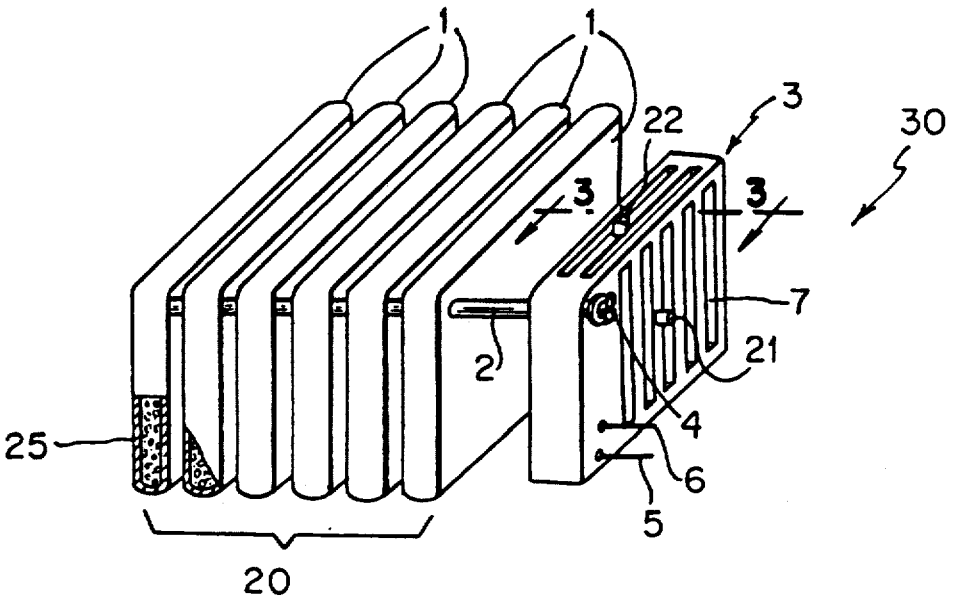
FIG. 1 gives a perspective view of a transportable cooling unit of the present invention.

The transportable cooling unit 30 illustrated in FIG. 1 includes an adsorption container assembly 20 having six flat adsorption containers 1, each containing a predetermined amount of zeolite 25. The adsorption containers 1 are connected with each other in vapor communication by an operating medium vapor conduit 2. The transportable cooling unit 20, in turn, is also connected with the cooling container 3 by the vapor conduit 2. Notably, the vapor conduit 2 is closable by a shut off means 4 as shown in greater detail in FIG. 3.

Figure 3:
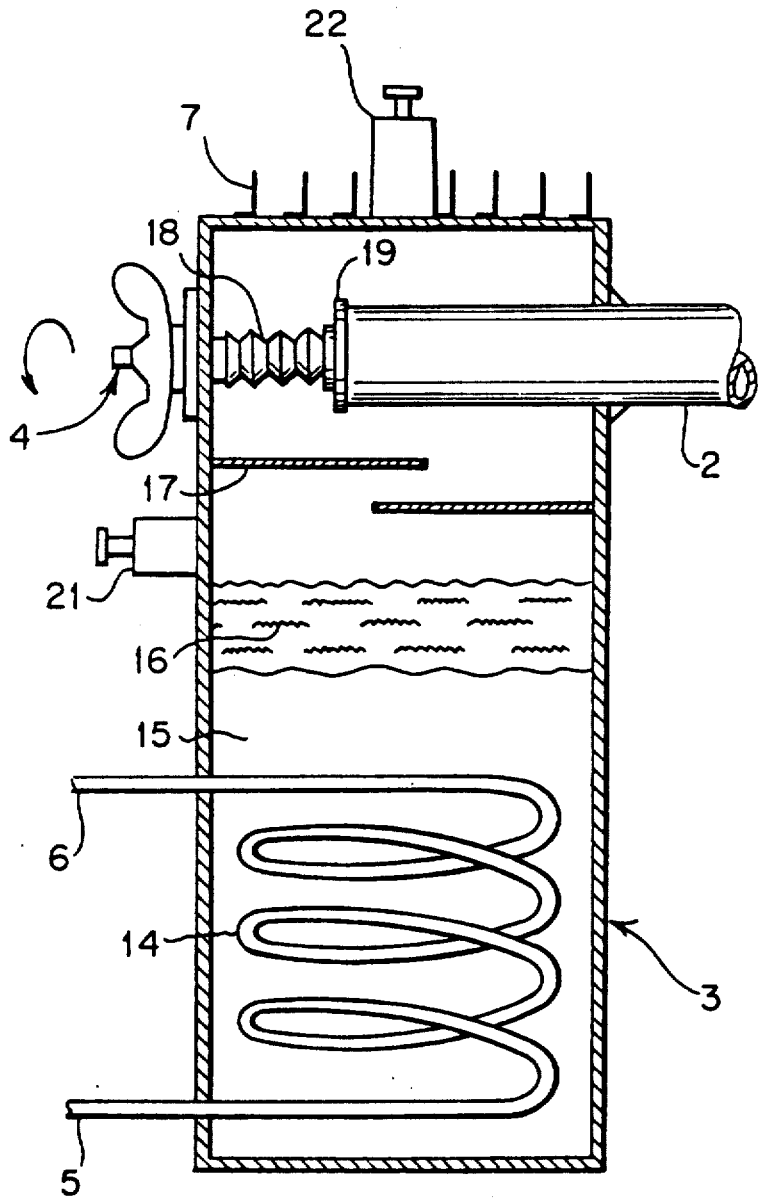
FIG. 3 shows a cross sectional view of the cooling container hereof taken along line 3—3 of FIG. 1.

Extending from the lower part of the cooling container 3 are the feeding and discharge ports 5 and 6, respectively. In the preferred embodiment, these ports are part of a beverage heat exchanger 14 which is illustrated in FIG. 3, but not in FIG. 1. On the outer wall of the cooling container 3, cooling ribs 7 are provided which enlarge the heat exchange surface area of the cooling container 3 so as to improve the transfer of the latent heat released to the ambient air during the condensation of desorbed vapor into liquid during the desorption phase. Notably, the outer wall and the cooling ribs 7 of cooling container function as a condenser, as will be discussed in great detail hereinafter.

Figure 2:
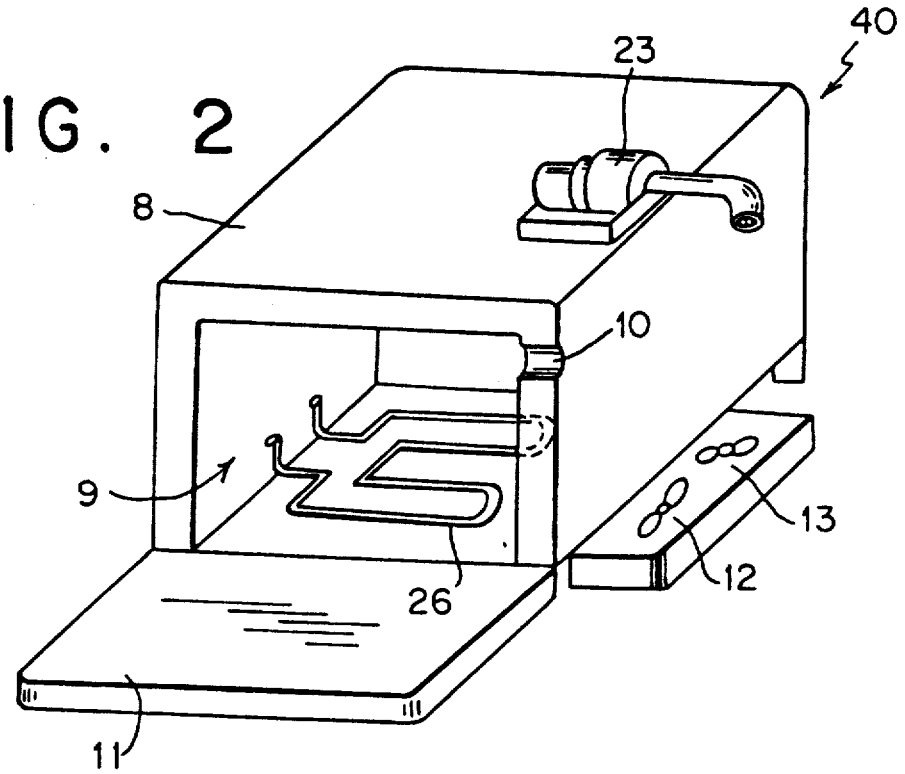
FIG. 2 shows a perspective view of the stationary charging (i.e. desorption) station of the present invention.

In FIG. 2, the stationary charging station 40 is shown from a perspective view. The charging station 40 comprises a temperature-controllable heating box 8 provided with an opening 9, wherein the adsorption container assembly 20 of the cooling unit is designed to insert therewithin. The temperature-controlled heating box 8 includes conventionally known heating means 26 such as an electrical heater and temperature control means in order to render the heating box 8 temperature controllable over the operating range of temperatures during the desorption (i.e. charging) phase of operation. A recess 10 for the vapor conduit 2 is provided at a corresponding location in the heating box 8, to permit lid 11 of the heating box to close shut after inserting the adsorption container assembly 20 therewithin during the desorption (i.e. charging) phase of cooler system operation. In this condition, the cooling container 3 is mounted over two cooling ventilators 12 and 13, which force ambient air over the cooling ribs 7 and/or heat exchanging wall surfaces of the cooling container. Notably, the cooling ribs 7 also function as a condensor for condensing desorbed water vapor during the desorption (i.e. charging) phase.

In FIG. 3, a cross-sectional view of the cooling container 3 is illustrated. In the lower part of the cooling container 3 and about the "beverage" heat exchanger 14, a reservoir is provided containing an amount of water 15. An inflow and outflow is provided for the heat exchanger 14 by feeding and discharge ports 5 and 6, respectively. Above the quantity of water 15, there is an ice layer 16 which forms during the adsorption phase as described hereinbefore. A drip separator 17 is provided above the ice layer 16 so as to partially separate the cooling container 3 and the heat exchanging surfaces thereof with the ambient environment, to form a condenser means in that portion of the cooling container during the charging phase.

In the upper portion of the cooling container 3, the discharge end of the vapor conduit 2 (illustrated in a broken away view) discharges desorbed vapor into the cooling container 3. This discharged vapor is allowed to condense around the drip separator 17 and drip into the cooling container 3 during the desorption phase. In the preferred embodiment, the shut off means 4 comprises a metallic bellow 18 and a flat packing 19 which, in the closed position, is mounted on the discharge end of the vapor conduit 2. On the outside of the cooling container 3, cooling ribs 7 are mounted for enlarging the heat exchanging surface of the cooling container, as required during the desorption (i.e. charging) phase.

As mentioned above, the use of the adsorption medium pair of zeolite/water is particularly advantageous in carrying out the present invention. Zeolite is a crystalline mineral consisting of a periodic three-dimensional crystalline structure consisting of silicon- and aluminum oxides. This crystalline structure contains small hollow (i.e. open) spaces or cavities wherein water molecules can be adsorbed by releasing heat of adsorption. Within the crystalline structure, the water molecules are subjected to strong field forces which liquify the molecules in the crystalline lattice and bind them in a liquified similar phase. The strength of the binding forces which act on the water molecules is dependent on the amount of water molecules already contained in the crystalline structure and the temperature of the adsorbing medium (e g. zeolite). In practical applications, up to 25 grams of water can be adsorbed per 100 grams of zeolite. Zeolites have several other properties which make them preferred in the present invention. In particular, zeolites are solid substances which do not present any interfering heat expansion during the adsorption or desorption reaction. Also, the crystalline structure of zeolite is freely accessible from all sides, for the water vapor molecules to bind thereto during the adsorption phase. Consequentially, the cooling unit of the present invention is operable in every possible position and orientation.

The use of water as the operating medium, on the other hand, permits the required control effort to be reduced to a minimum. During or evaporation of water under vacuum (i.e. low vapor pressure) conditions in the cooling container 3, the water surface cools to 0° C. and freezes to ice 16 due to the continuous evaporation process which occurs during the adsorption phase. This layer of ice grows within a short time in the cooling container 3 until the generated vapor pressure drop above the ice layer stops the growth.

In the apparatus of the present invention, this ice layer can advantageously be used for controlling the beverage discharge temperature. During low beverage tapping conditions, the ice layer grows, and under very large beverage tapping conditions, the ice layer melts. The temperature of the water under the ice layer is +4°, since water has its highest density at this temperature. Since the cooling container is so designed that the (beverage) heat exchanger 14 therein is always below the ice layer, the tapped beverage from port 6 has a discharge temperature of +4° to +9° C., independent from the temperature of the beverage entering the heat exchanger from port 5. Thus, by using this anomalous effect of water, the control unit typically required for the shut off means of conventional adsorption cooling systems, can be deleted altogether in the sorption cooling system of the present invention.

The cooling capacity of the cooling unit at the time of beverage tapping, is determined by the amount of the desorbed zeolite in the adsorption container as well as the zeolite temperature attained prior to the time of beverage tapping. Hence, the amount of zeolite can be designed so that one cooling unit has a cooling capacity sufficient for cooling a complete beverage container (e.g. barrel of beer, lemonade container, etc.).

After returning the discharged cooling unit to the vendor, the discharged cooling unit 30 together with the adsorption container assembly 20 is placed into the opening 9 of the heating box 8 of the changing station 40, and lid 11 is closed, with the cooling container 3 being positioned outside the heating box 8, above the cooling ventilators 12 and 13. In this configuration, "recharging" (i.e. desorption) of the discharged cooling unit 30 is achieved.

During this recharging process with the discharged cooling unit 30 attached to the charging station 40 as described above, the adsorption medium (e.g. zeolite) 25 is heated and the operating medium (e.g. water) 15 is evaporated or desorbed from the adsorption medium 25 and forms vapor or steam. The desorbed vapor passes through the "opened" vapor conduit 2, into the cooling container 23 where it is reliquified or condensed by use of a suitable heat exchanger e.g. cooling fins 7. Thereafter, the condensed operating liquid 15 is allowed to drip into the cooling container 3. Typically, the temperature of the heating box 8 is between 250° and 350° C. at the end of the charging (i.e. desorption) phase. As soon as the adsorption medium is heated and the operating medium is desorbed therefrom, the shut-off means 4 is closed, and the entire cooling unit 30 is separated from the charging station 40. With the shut-off means 4 closed, the adsorption container assembly 20 is allowed to cool off to ambient temperature, but cannot suction off vapor from the cooling container 3. Until the next use, the "charged" cooling unit 30 can be stored at room temperature.

A high vacuum tightness is required by the shut-off 4 device, particularly when using the zeolite/water sorption substance pair. Furthermore, the shut-off device 4 should be so designed that it opens automatically and permits the operating medium vapor to flow into the cooling container 3, as soon as the vapor pressure in the adsorption container assembly 20 is higher than the vapor pressure in the cooling container 3. In this manner, it is assured that no excess pressure is generated in the adsorption container assembly 20 during the desorption (i.e. charging) phase, that is, should the shut-off device 4 be accidentally closed. Moreover, the cooling unit 30 may be additionally provided with an excess pressure relief/safety means in either or both of the adsorption container assembly 20 and the cooling container 3. As illustrated in FIG. 3, the excess pressure relief/safety means 21 is provided to the cooling container 3 through one of the container walls thereof. Preferably, the position of the excess pressure relief/safety means 21 is above the layer 16 of ice formation.

During the desorption phase, when using operating medium with boiling temperature points beyond the ambient temperature, it is advantageous to provide a suctioning-off device 22 through which air or foreign gas can be suctioned off from the cooling container 3 with the assistance of vacuum equipment 23 mounted, for example, upon heating box 8 as illustrated in FIG. 2. Advantageously, this evacuation equipment 22 and 23 may be combined with the excess pressure relief/safety means 21.

In the present invention, the adsorption container assembly 20 is advantageously designed so that externally supplied "desorption heat" can be fed between and over its adsorption container walls so that the adsorption heat can be discharged to the ambient environment during the adsorption phase. Particularly suitable for the adsorption containers 1 are flat containers which are connected with each other by way of the (vapor) conduit 2 as shown in FIG. 1 and described hereinbefore. The adsorption medium 25 in each container advantageously contains vapor conduits, through which the vapor operating medium passes in order that the operating medium eventually becomes evenly distributed within each adsorption container.

Having described one embodiment of the present invention, several modifications thereto come to mind. In particular, it is also possible to forego altogether the heat exchange condensor formed in the cooling container using cooling fins 7 and heat exchanging wall surfaces of the cooling container 3. As an alternative, the beverage heat exchanger 14 presented within the cooling container, can be used during the desorption phase, to condense the desorbed vapor from the zeolite, into liquid. This is achieved by permitting the heat exchanger 14 to extend out and away from the liquid operating medium during the desorption phase, in order to function as a condensor. In the preferred embodiment, this feature is achieved by permitting the heat exchanging coil 14 to rotate out of the liquid operating medium during the desorption phase, and to extend above the liquid operation medium. Thus, the heat exchanger 14 so adapted, can function to condense the desorbed vapor during desorption phase, as follows. The adsorption container 20 is inserted into the heating box 8 and the complete system 30 is rotated (with respect to gravity) to such an extent that the beverage heat exchanger 14 extends at least partially out from the liquid operating medium 15. In this configuration, cooling tap water may be passed through the beverage heat exchanger 14 during the charging phase, so as to assist in condensing the desorbed vapor driven off of the adsorption medium. With this system configuration, the need for forced air cooling outside the charging station 40 is eliminated.

The advantages of the sorption cooler of the present invention are manifest. Since the charging station typically remains with the given beverage distributor, it constitutes a single expense. All expensive and heavy components like the electrical heater, temperature control devices, heating box insulation, and additional components like evacuation unit, cooling vent, etc. can be mounted on the charging station. In this manner, then, the transportable cooling unit is light and cost effective. It does not require its own energy connection at the customer level. The cooling capacity of the charged cooling unit is immediately available to the customer. Moreover, the cooling unit of the present invention is characterized by an exceptionally high cooling reserve, so that a more lengthy beverage tapping operation is now possible using a single "charged" cooling unit of the present invention. After depleting the cooling capacity of the cooling unit, the cooling unit becomes essentially worthless for the customer without having a separate charging station. Hence, the customer willingly returns the "discharged" cooling unit to the distributor after receiving his initially paid deposit on the cooling unit.

While the particular embodiment shown and described above has proven to be useful in many applications involving the periodic adsorption cooling art, further modification herein disclosed will occur to persons skilled in the art to which the present invention pertains and also such modifications are deemed to be within the scope and spirit of the present invention defined by the dependent claims.

What is claimed is:

1. A sorption cooling system which comprises:

a transportable cooling unit including an adsorption container, a cooling container, and an operating medium vapor conduit, said operating medium vapor conduit connecting said adsorption container and said cooling container in vapor communication, said adsorption container containing an adsorption medium, said cooling container containing a liquid operating medium and a first heat exchanging means being surroundable by said liquid operating medium, and said operating medium vapor conduit having a shut off means for closing said operating medium vapor conduit so as to isolate said adsorption container from said cooling container; and a charging station having a temperature controllable heating enclosure including heating means and having an opening for removable insertion of at least the adsorption container of said transportable cooling unit in order to provide for heating and recharging of said cooling unit when the unit is inserted therein and to permit removal of the recharged unit therefrom for transportation and use as a cooling unit independent of and remote from said charging station.

2. The adsorption cooling system in accordance with claim 1 wherein said cooling unit further comprises a second heat exchanging means for discharging heat of condensation liberated by said operating medium when operating medium is condensed into liquid operating medium during desorption of said absorption medium while said cooling unit is disposed in said charging station.

3. The absorption cooling system in accordance with claim 2, wherein said cooling container further includes a drip separator disposed within said cooling container, for allowing vapor operating medium to condense around said drip separator and drip into said cooling container during said desorption phase.

4. The adsorption cooling system in accordance with claim 1, wherein said cooling unit is detached from said charging station, and wherein said shut off means is also selectively operable to permit liquid operating medium in said cooling container to evaporate into vapor operating medium and pass through said operating medium vapor conduit and into desorbed adsorption medium, so that liquid operating medium remaining in said cooling container is at least partially solidified.

5. The adsorption cooling system in accordance with claim 1, wherein said first heat exchanger is mounted in said cooling container in such a manner that by rotating said transportable cooling unit, said first heat exchanger extends at least partially from said liquid operating medium so as to be capable of absorbing the condensation heat released during said condensing of said vapor operating medium in said cooling container.

6. The adsorption cooling system in accordance with claim 1, wherein said shut off means is so arranged that it automatically opens when the vapor pressure of said operating medium in said adsorption container is higher than the vapor pressure of the operating medium in the cooling container.

7. The adsorption cooling system in accordance with claim 1, wherein said cooling unit further comprises one of an evacuation device or an excess pressure valve.

8. The adsorption cooling system in accordance with claim 1, wherein said charging station further comprises heat discharged means for discharging condensation heat released when said operating medium vapor is condensed into operating medium liquid in said cooling container.

9. The adsorption cooling system in accordance with claim 1, wherein said adsorption container has a plurality of walls, and one or more of said walls are formed as heat exchanging means for transfer of heat to be supplied to and/or radiated from said adsorption medium contained in said adsorption container.

10. The adsorption cooling system in accordance with claim 1, wherein said operating medium is water and said adsorption medium is a zeolite.

* * * * *